US010502513B2

(12) United States Patent
Ellison et al.

(10) Patent No.: US 10,502,513 B2
(45) Date of Patent: Dec. 10, 2019

(54) FIREARM SOUND SUPPRESSOR AND METHODS OF MANUFACTURE

(71) Applicant: Ellison Dynamic Concepts, LLC, Mason, OH (US)

(72) Inventors: Benjamin Ellison, Maineville, OH (US); Tyler Jepson, Cincinnati, OH (US); Matthew Martin, Cincinnati, OH (US)

(73) Assignee: Benjamin R. Ellison, Maineville, OH (US)

( * ) Notice: Subject to any disclaimer, the term of this patent is extended or adjusted under 35 U.S.C. 154(b) by 0 days.

(21) Appl. No.: 16/225,104

(22) Filed: Dec. 19, 2018

(65) Prior Publication Data

US 2019/0186860 A1 Jun. 20, 2019

Related U.S. Application Data

(60) Provisional application No. 62/608,101, filed on Dec. 20, 2017.

(51) Int. Cl.
*F41A 21/30* (2006.01)
*F41A 21/32* (2006.01)

(52) U.S. Cl.
CPC ..... *F41A 21/30* (2013.01); *F41A 21/325* (2013.01)

(58) Field of Classification Search
CPC ..... F41A 21/30; F41A 21/32; F41A 21/325; F41A 21/34; F41A 21/36
USPC ..... 42/79.1; 89/14.3, 14.4; 181/223
See application file for complete search history.

(56) References Cited

U.S. PATENT DOCUMENTS

| | | | | |
|---|---|---|---|---|
| 916,885 | A * | 3/1909 | Maxim | F41A 21/30 181/223 |
| 3,409,232 | A * | 11/1968 | Cholin | A62C 13/006 239/499 |
| 6,079,311 | A * | 6/2000 | O'Quinn | F41A 21/30 42/79 |
| 7,587,969 | B2 * | 9/2009 | Silvers | F41A 21/30 181/223 |
| 7,931,118 | B1 | 4/2011 | Cronhelm | |
| 8,087,338 | B1 * | 1/2012 | Hines | F41A 21/30 181/223 |
| 8,307,946 | B1 * | 11/2012 | Johnston | F41A 21/30 181/223 |
| 8,322,266 | B2 * | 12/2012 | Presz, Jr. | F41A 21/34 89/14.2 |

(Continued)

FOREIGN PATENT DOCUMENTS

WO 2016046374 A1 3/2016

*Primary Examiner* — Derrick R Morgan
(74) *Attorney, Agent, or Firm* — Wood Herron & Evans LLP

(57) ABSTRACT

A firearm noise suppressor attachable to the muzzle of a barrel having a longitudinal bore axis. It includes a housing with an outer wall, a forward end wall, and a rearward end wall. The rearward end wall attaches to a firearm barrel and the forward end wall includes an outlet opening aligned with the longitudinal bore axis. A blast chamber is defined at least in part by the rearward end wall, the outer wall, and a blast baffle. At least a second baffle is situated forward of the blast baffle and supported at a periphery by the outer wall. A plurality of circumferentially spaced apart helical blast vanes in the blast chamber impart a rotational flow to propellant gas.

5 Claims, 6 Drawing Sheets

(56) References Cited

U.S. PATENT DOCUMENTS 8,424,635 B1* 4/2013 Klawunn ..... F41A 21/34 181/223
8,516,941 B1* 8/2013 Oliver ..... F41A 21/30 181/223
8,528,691 B1* 9/2013 Carmichael ..... F41A 21/30 181/223
8,739,922 B2 6/2014 Wirth et al.
8,820,473 B1 9/2014 White
8,844,422 B1* 9/2014 Klett ..... F41A 21/30 89/14.2
8,875,612 B1* 11/2014 Klett ..... F41A 21/30 89/14.4
8,881,862 B1* 11/2014 Messer, Jr. ..... F41A 21/30 181/223
9,038,771 B1* 5/2015 Mueller ..... F41A 21/30 181/223
9,115,949 B1* 8/2015 Morrison ..... F41A 21/30
9,239,201 B1* 1/2016 Reis Green ..... F41A 21/30
9,316,456 B1 4/2016 Oliver
9,347,727 B1* 5/2016 Cler ..... F41A 21/30
9,593,899 B2 3/2017 Coppinger et al.
9,599,421 B1* 3/2017 Dean ..... F41A 21/30
9,658,010 B1* 5/2017 Oglesby ..... F41A 13/12
9,702,651 B2 7/2017 Petersen
9,719,745 B2 8/2017 Palu et al.
9,835,399 B1* 12/2017 Lessard ..... F41A 21/34
9,851,166 B2* 12/2017 Petersen ..... F41A 21/30
9,982,959 B2 5/2018 Washburn, III et al.
10,126,084 B1* 11/2018 Oglesby ..... F41A 21/30
10,345,070 B1* 7/2019 Lepka ..... F41A 21/30
2007/0107590 A1* 5/2007 Silvers ..... F41A 21/30 89/14.4
2010/0163336 A1* 7/2010 Presz, Jr. ..... F41A 13/08 181/223
2011/0067950 A1* 3/2011 Shults ..... F41A 21/30 181/223
2011/0107900 A1* 5/2011 Presz, Jr. ..... F41A 21/34 89/14.4
2011/0186377 A1* 8/2011 Kline ..... F41A 21/30 181/223
2014/0224575 A1* 8/2014 Latka ..... F41A 21/30 181/223
2014/0262605 A1* 9/2014 Washburn ..... F41A 21/30 181/223
2014/0299405 A1* 10/2014 Miller ..... F41A 21/30 181/223
2014/0374189 A1* 12/2014 Young ..... F41A 21/30 181/223
2015/0001001 A1* 1/2015 Wilson ..... F41A 21/30 181/223
2015/0101882 A1* 4/2015 Moss ..... F41A 21/30 181/223
2015/0184968 A1* 7/2015 Fischer ..... F41A 21/30 89/14.4
2015/0285575 A1* 10/2015 Sclafani ..... F41A 21/30 181/223
2016/0061551 A1 3/2016 Petersen
2016/0109205 A1* 4/2016 Coppinger ..... F41A 21/30 89/14.4
2016/0161203 A1* 6/2016 Wilson ..... F41A 21/30 89/14.3
2016/0209149 A1* 7/2016 Fischer ..... F41C 33/02
2017/0067711 A1* 3/2017 Slack ..... F41A 21/30
2017/0102201 A1* 4/2017 Bush ..... F41A 21/30
2017/0102202 A1* 4/2017 Augustine ..... F41A 21/30
2017/0151721 A1* 6/2017 Stephenson ..... B33Y 80/00
2017/0160036 A1* 6/2017 Walker ..... F41A 21/36
2017/0205173 A1* 7/2017 Thomas ..... F41A 3/40
2017/0205174 A1* 7/2017 Petersen ..... F41A 21/30
2017/0299312 A1* 10/2017 Llewellyn, Jr. ..... F41A 21/30
2017/0307323 A1* 10/2017 Couvillion ..... F41A 21/34
2018/0023914 A1* 1/2018 Latka ..... F41A 21/30 89/14.4
2018/0031346 A1* 2/2018 Washburn, III ..... F41A 21/30
2018/0135932 A1 5/2018 Tomczak
2018/0224235 A1* 8/2018 Couvillion ..... F41A 21/30
2018/0238653 A1* 8/2018 Kunsky ..... F41A 21/325
2018/0252489 A1* 9/2018 Parker ..... F41A 21/30
2018/0292160 A1* 10/2018 Petersen ..... F41A 21/28
2018/0306544 A1* 10/2018 White ..... F41A 21/38
2018/0313626 A1* 11/2018 Tomczak ..... F41A 21/30
2018/0321008 A1* 11/2018 Barney ..... F41A 21/30
2019/0145727 A1* 5/2019 Campbell ..... F41A 21/30 89/14.4
2019/0257607 A1* 8/2019 Dobrinescu ..... F41A 21/30

* cited by examiner

FIREARM SOUND SUPPRESSOR AND METHODS OF MANUFACTURE

RELATED APPLICATIONS

This application claims priority to U.S. Provisional Patent Application No. 62/608,101, filed Dec. 20, 2017, and incorporates the same herein by reference.

TECHNICAL FIELD

The present invention relates to various embodiments of an apparatus for suppressing the muzzle blast and attendant noise of a discharging firearm and to methods of manufacturing the same. In particular, the methods relate to uses of additive manufacturing, also known as 3D printing.

BACKGROUND

Firearm sound suppressing devices, often referred to simply as "suppressors" or "silencers," that may be integral with the barrel or attached to the muzzle end of a barrel are well known. In general, such devices reduce the sound produced by high pressure gasses rapidly escaping the muzzle when fired by trapping the burst of gas pressure in an enclosed housing to slow the release to the atmosphere (to attenuate the pressure wave), consuming energy of the muzzle blast by creating turbulence and redirecting the flow of gas pressure, and/or absorbing heat energy. The most common types of sound suppressing devices include a housing whose interior volume is divided into multiple chambers by baffles, having a longitudinal passageway axially aligned with the bore of the barrel to allow a fired projectile to pass unencumbered.

The design of an effective suppressor must address its exposure to both high internal pressure and heat. Traditionally, suppressors have been made by providing a metallic tubular or cylindrical housing with attached endcaps and milling or turning metallic baffles to be held inside the tubular housing. The advent of additive manufacturing (also known as 3D printing) has expanded the range of designs that are possible to produce. At the same time, new issues must be addressed in this alternate form of manufacturing.

SUMMARY OF THE INVENTION

The present invention provides a firearm noise suppressor that can be made by additive manufacturing processes. It includes integral concentric conical baffles and can include helical vanes in the blast chamber.

More specifically, it can include a housing having an outer wall, a forward end wall, and a rearward end wall. The rearward end wall will include means for attachment to a firearm barrel, and the forward end wall will include an outlet opening substantially aligned with the longitudinal bore axis to allow passage of a projectile. A blast chamber is defined at least in part by the rearward end wall, the outer wall, and a blast baffle. The blast baffle includes an opening substantially aligned with the longitudinal bore axis to allow passage of the projectile. At least a second baffle is situated forward of the blast baffle, is supported at a periphery by the outer wall, and defines at least a secondary chamber between it and the blast baffle. A plurality of circumferentially spaced apart helical blast vanes in the blast chamber impart a rotational flow to the propellant gas.

The method of manufacturing can include printing by additive manufacturing a precursor part having a housing with a center axis, side walls, a forward end wall, a rearward end wall, and defining an internal volume. The housing has internal baffles separating the internal volume into chambers, and has temporary internal support structure along at least a portion of the center axis. A central bore passageway along the center axis is bored to remove the temporary internal support structure and to form openings of predetermined size in the baffles and forward wall and to form an interim opening in the rearward wall. Internal manufacturing debris is removed from the chambers through at least one of the interim opening and the forward wall opening. A larger opening is bored in the rearward wall to form an attachment opening, and attachment means is provided in the attachment opening.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
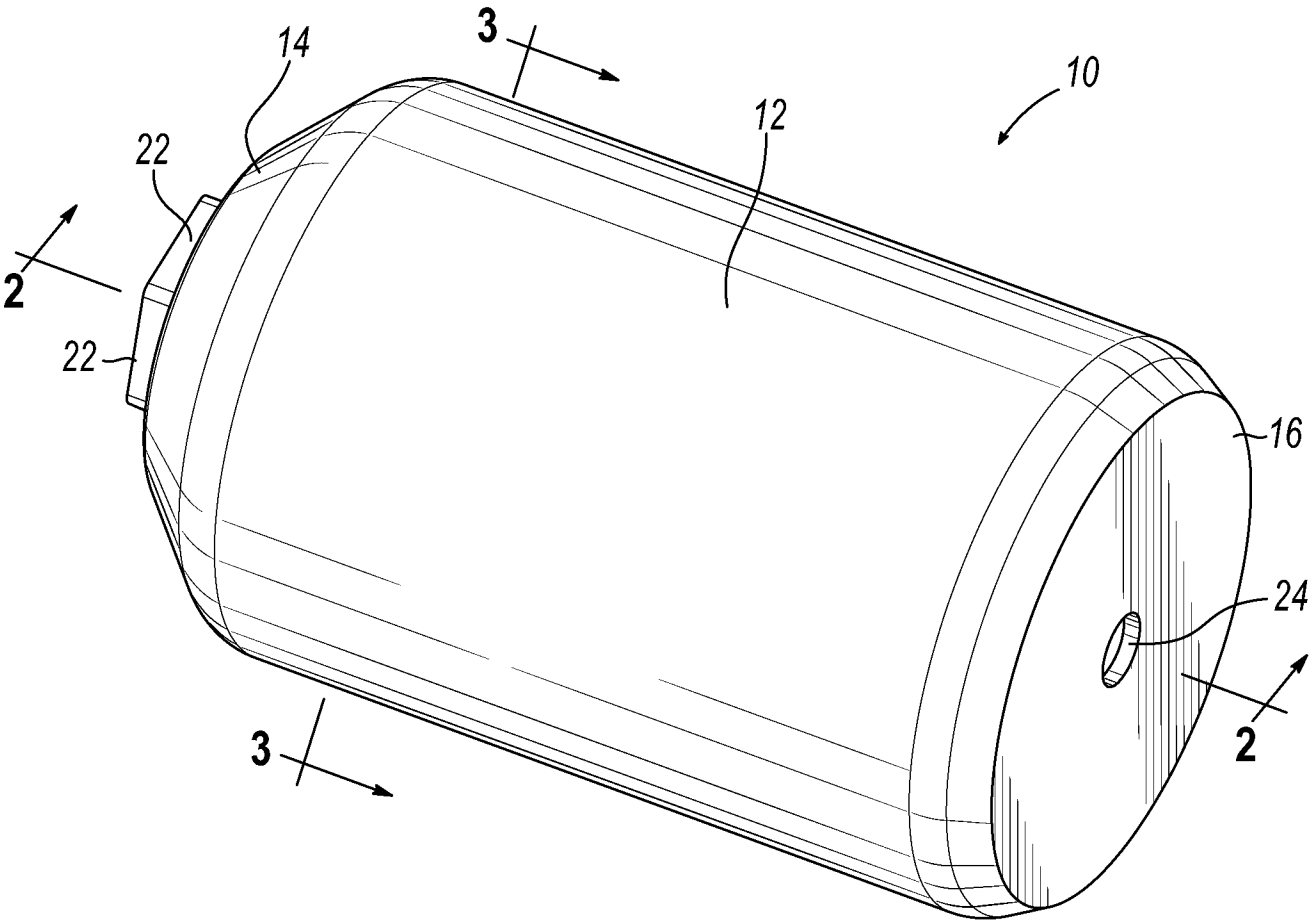
FIG. 1 is an isometric external view of a firearm sound suppressor according to a first embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

As used herein, "axial" and "longitudinal" refer to the direction of the length of a firearm barrel and the path of a projectile fired therefrom. "Forward" refers to the direction a projectile is fired and distal from the shooter; "rear" or "aft" refers to the direction toward and proximal to the shooter. "Lateral" refers to a direction offset to a side from the longitudinal axis and "transverse" refers to a direction substantially perpendicular to or crossing the longitudinal direction. "Side wall" and "side walls" are used interchangeably herein to include a cylindrical and/or polygonal shape.

Referring first to FIG. 1, therein is shown a firearm noise suppressor 10 according to a first embodiment of the present invention. The suppressor 10 includes an outer wall that 12 may provide a substantially cylindrical housing having a circular (shown) or other polygonal cross-sectional shape, a rear end wall 14, and a forward end wall 16. The rear and forward end walls 14, 16 may be substantially flat, rounded, tapered, and/or frustoconical in shape. The rear end wall 14 may include means for attachment to the muzzle of a firearm barrel (not shown). The attachment may be any of several well-known means, such as a direct threaded engagement (shown) or a quick disconnect mount (not shown). The illustrated embodiment includes a neck portion 18 having a threaded bore surface 20 to engage corresponding threads on the muzzle end of the barrel and may include exterior wrench flats 22 or other means for engaging a tool to apply torque for attaching or removing the suppressor 10 from a firearm barrel. The forward end wall 16 includes an exit opening 24 that is coaxially aligned with the bore of the firearm barrel, when attached, and is sized to allow a projectile fired from the barrel to pass unimpeded.

Figure 2:
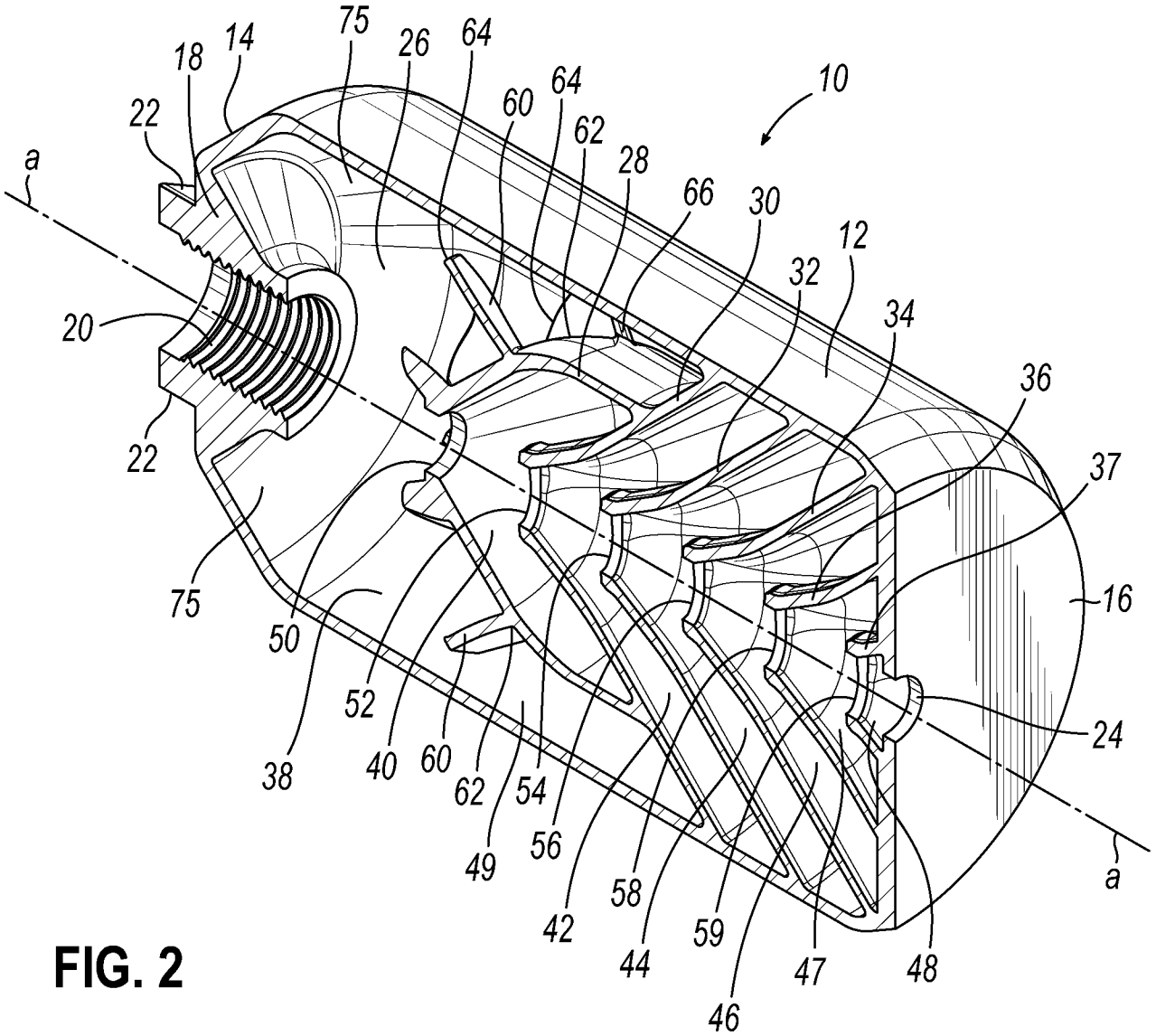
FIG. 2 is an isometric longitudinal sectional view thereof taken substantially along line 2-2 of FIG. 1.

Referring now in particular to FIG. 2, the outer wall 12 and end walls 14, 16 define an inner volume 26 that may be substantially completely enclosed, except for the exit opening 24 in the forward end wall 16, when the suppressor 10 is attached to a firearm barrel. The inner volume 26 may be divided into separate chambers by a series of integral coaxial, substantially conical baffles 28, 30, 32, 34, 36, 37. A first or blast chamber 38 is defined within the inner volume by the rear end wall 14, a portion of the outer wall 12, and a first baffle 28. Because this first baffle 28 is directly impinged upon by the blast of propellant gas exiting the muzzle, it is sometimes referred to as a "blast baffle." A second chamber 40 is defined between the first and second baffles 28, 30, a third chamber 42 is defined between the second and third baffles 30, 32, a fourth chamber 44 is defined between the third and fourth baffles 32, 34, a fifth chamber 46 is defined between the fourth and fifth baffles 34, 36, a sixth chamber 48 is defined between the fifth baffle 36 and the sixth baffle 37, and a seventh chamber 47 is defined between the sixth baffle 37 and the forward end wall 16. The number of baffles and chambers may vary, as desired, depending upon the caliber and velocity of the projectile to be fired therethrough, which largely determines the pressure and volume of propellant gas to be contained and/or controlled by the suppressor 10. In the illustrated embodiment, the volume of each of the chambers 38, 40, 42, 44, 46, 47, 48 is successively reduced in the order through which the projectile and propellant gas will pass before passing through the exit opening 24. When the outer wall 12 has a diameter that is large relative to the projectile diameter (as in the illustrated embodiment), the axial spacing of the baffles 28, 30, 32, 34, 36, 37 can be relatively closer together while maintaining the desired volume of the chambers 40, 42, 44, 46, 47, 48.

In the illustrated embodiment, for example, the first (or blast) baffle 28 connects to and is supported by the second baffle 30, rather than by the outer wall 12. This construction defines a forward annular extension portion 49 of the blast chamber 38 between the first baffle 28 and outer wall 12 that may be partially defined at its forward end by an outer portion of the second baffle 30. A like structure would result from considering the first baffle 28 to be supported by the outer wall 28 and the second baffle 30 to be supported on the interior or forward side of the first baffle 28. Also in the illustrated embodiment, the second and third baffles 30, 32 extend to and are supported by the outer wall 12, the fourth baffle is supported at the intersection of the outer wall 28 and forward end wall 16, while the fifth and sixth baffles 36, 37 are supported by the forward end wall 16.

Each of the baffles 28, 30, 32, 34, 36, 37 includes a passageway 50, 52, 54, 56, 58, 59 that is axially aligned with the bore of the barrel and exit opening 24 to allow unimpeded passage of a projectile (labeled as axis a in FIG. 2). The diameter of each baffle passageways 50, 52, 54, 56, 58, 59 may be selected to allow passage of a projectile of the largest caliber expected to be used with the suppressor 10. These can be enlarged to ensure that there is no contact with the path of the projectile, but enlargement can affect sound-suppressing performance of the device 10. If desired, the shape of the baffle passageways 50, 52, 54, 56, 58, 59 may be asymmetrical or irregular to disrupt or otherwise affect the flow of expanding propellant gas from one chamber to the next.

As previously described, the highest pressure and velocity of rapidly expanding propellant gas exiting the muzzle will enter the blast chamber 38 and be directed toward the first baffle 28. Likewise, the greatest amount of sound-reduction performance may be achieved in the blast chamber 38. The longer the propellant gas is retained in the blast chamber 38, and the greater the amount of kinetic and heat energy removed in the blast chamber 38, the greater is the sound-reducing performance of the subsequent chambers 40, 42, 44, 46, 47, 48 and of the suppressor 10 overall. The present invention maximizes this performance by maximizing the heat-removing surface area and energy consuming turbulence of the gas in the blast chamber 38.

Figure 3:
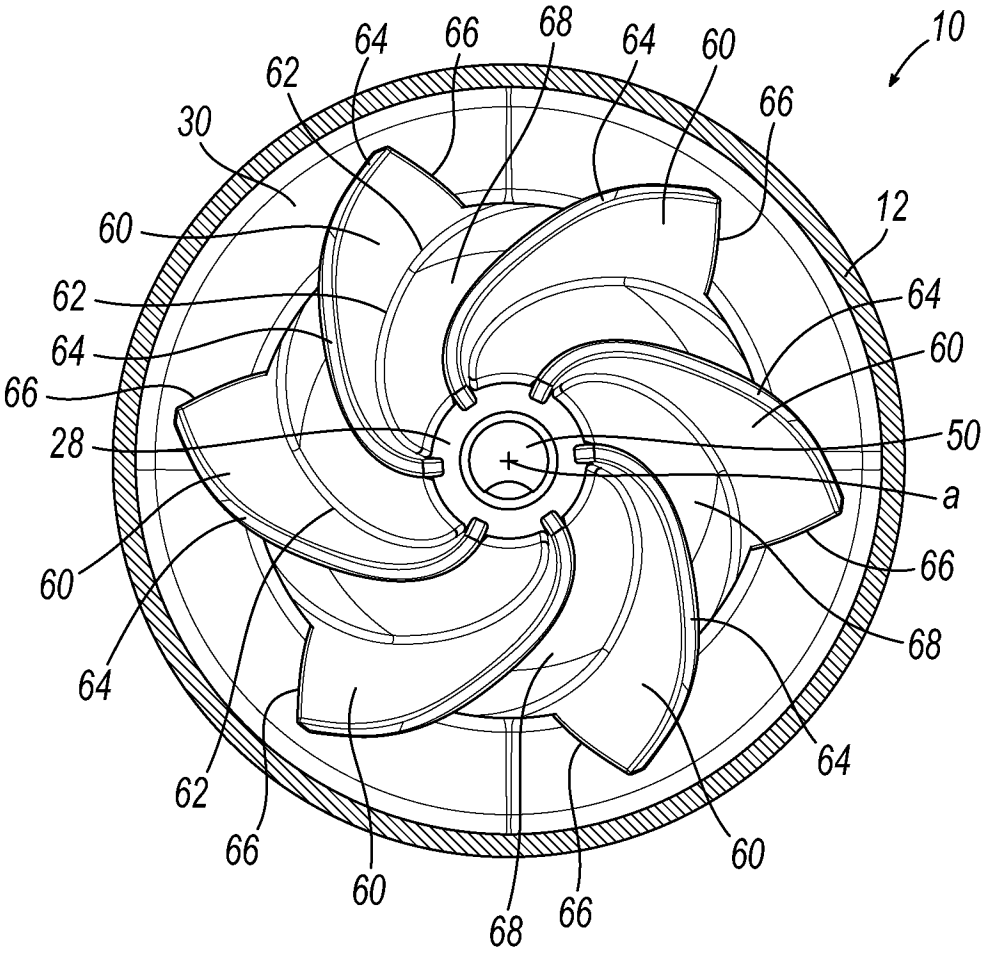
FIG. 3 is a cross sectional view thereof taken substantially along line 3-3 of FIG. 1.
Figure 4:
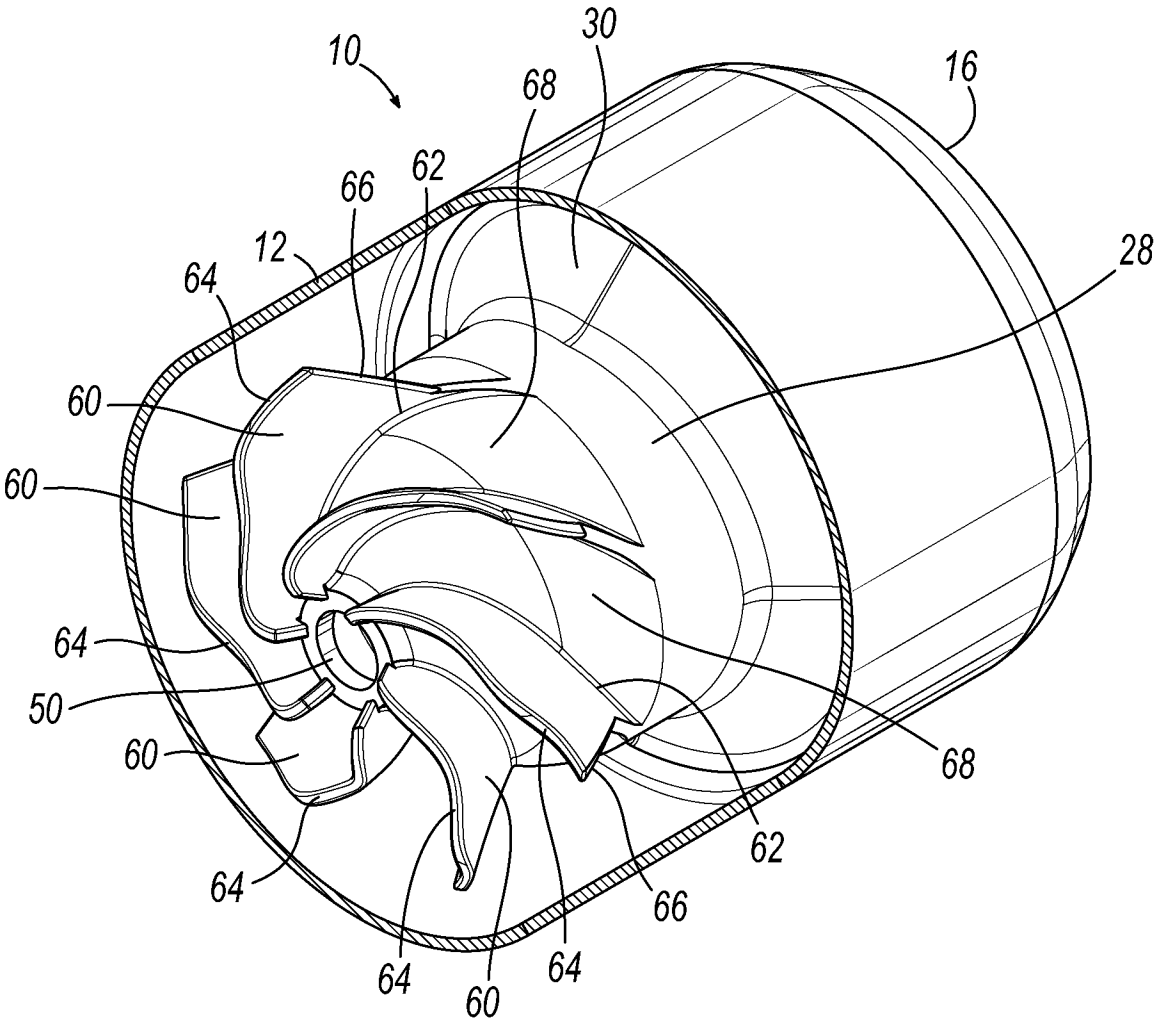
FIG. 4 is a different isometric view thereof with rear and side parts of the exterior housing cut away.

Referring now also to FIG. 3, the first or blast baffle 28 may include a plurality of blast vanes 60 that extend radially and helically relative to the longitudinal axis a and the projectile passageway 50 in the blast chamber 38. Each blast vane 60 includes an inner edge 62, at which it can be attached to or extend from the first baffle 28, a leading edge 64, which first confronts the stream of high pressure and velocity propellant gas exiting the muzzle, and a trailing edge 66, defining a terminus of each vane 60. If desired (as illustrated), the vanes 60 may increase in height relative to the conical angle of the blast baffle 28 so that the leading edges 64 are substantially along a plane perpendicular to the axis a. Helical channels 68 having an increasing radius are defined between each of the blast vanes 60. As can be seen best in FIG. 3, this arrangement of blast vanes 60 imparts a rotational flow to the stream of propellant gas, while increasing the surface area to be impacted by the stream to increase turbulence and absorb heat energy. The direction can be chosen to correspond to or counter the direction of spin given the projectile by the barrel rifling. The thickness of each vane 60 will be selected as necessary to withstand the dynamic force and abrading effect of the high-pressure stream of hot propellant gas. The helical flow imparted to the stream of propellant gas expanding into the blast chamber 38 further impedes and delays its eventual escape from the blast chamber 38, all of which must escape through the passageway 50 of the first baffle 28 and into subsequent chambers 40, 42, 44, 46, 47, 48, which further delaying and allow significant pressure reduction before passing through the exit opening 24.

Figure 5:
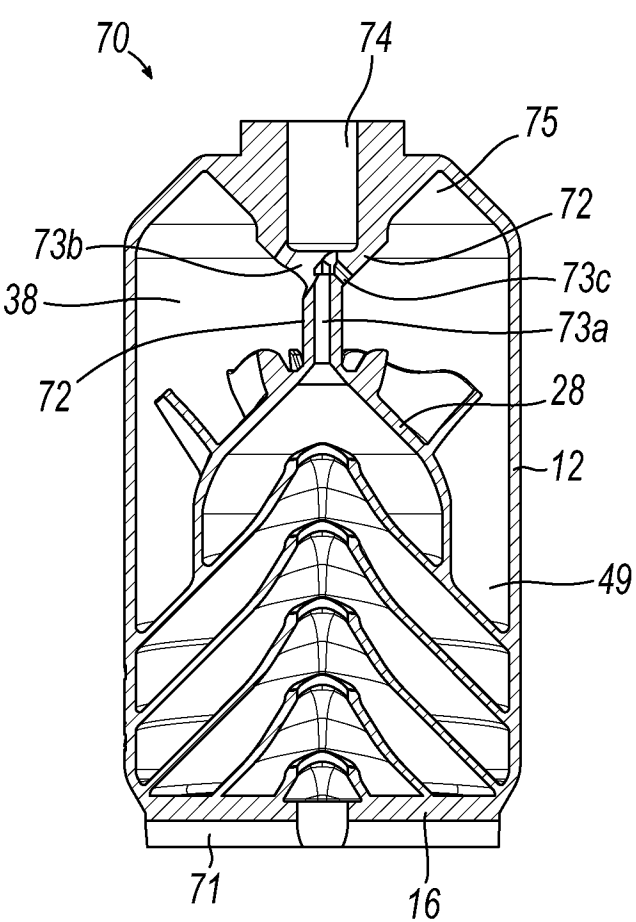

Referring now to FIGS. 5-9, the present invention includes methods of manufacturing a suppressor 10, such as the one described above. FIG. 5 shows a cross-sectional view of a precursor part 70 to the suppressor 10 in a condition as it may initially appear when manufactured by 3D printing. The suppressor 10 is "printed" beginning with the forward end wall 16 and proceeding to form the baffles 30, 32, 34, 36, 37 and outer wall 12. The blast baffle 28 and vanes 60 are formed as the outer wall is continued. Finally, the rear end wall 14 and neck portion are formed. The precursor part 70 may include internal support structure 72 required during the additive manufacturing processes. If desired, the forward end wall 16 can include additional indexing material 71 that is cut or milled away to provide a finished end surface.

The support structure 72 can be formed with ports or passageways 73*a*, 73*b*, 73*c*. Typically, powder material or other debris encased in the body of the precursor part 70, present in and a result of many additive manufacturing processes, can be removed from the conical chambers 40, 42, 44, 46, 47, 48 through the passageways 52, 54, 56, 58, 59 and opening 24 in the forward wall and/or the axial passageway 73*a* in the support structure 72 by gravity simply by inverting and/or shaking/tapping the part 70. Powder material or other debris in the blast chamber 26 can be more difficult to remove by gravity because it will collect in the forward annular extension portion 49 or (when inverted) in the area 75 defined between the conical rear wall 14 and neck portion 18. To remove powder material or debris from the blast chamber 26, an angled nozzle (not shown) can be inserted into the larger passageway 73*b* and used to introduce a stream of high velocity air to create a vortex that will lift (fluidize) the material and force it to flow out through the other passageway 73*c*.

Figure 6:
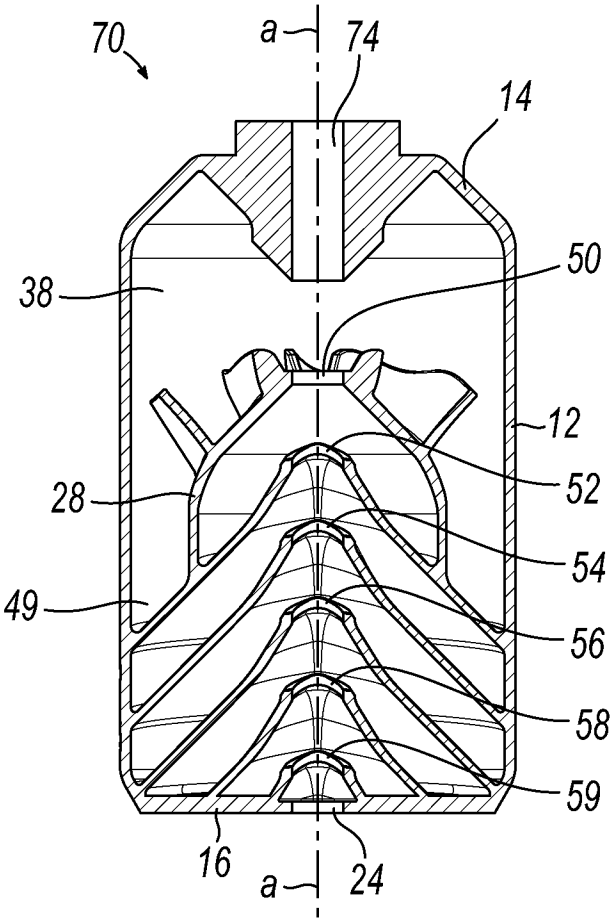
FIGS. 5-9 are side sectional views thereof showing a series of manufacturing stages.

As shown in FIG. 6, a portion of the internal support structure 72 may be removed by creating an axial bore 74, such as by drilling, along the center axis a from either end. This drilling step can define the final diameter of the blast baffle passageway 50, and it may also be used to size the other baffle passageways 52, 54, 56, 58, 59 and the exit opening 24.

Figure 9:
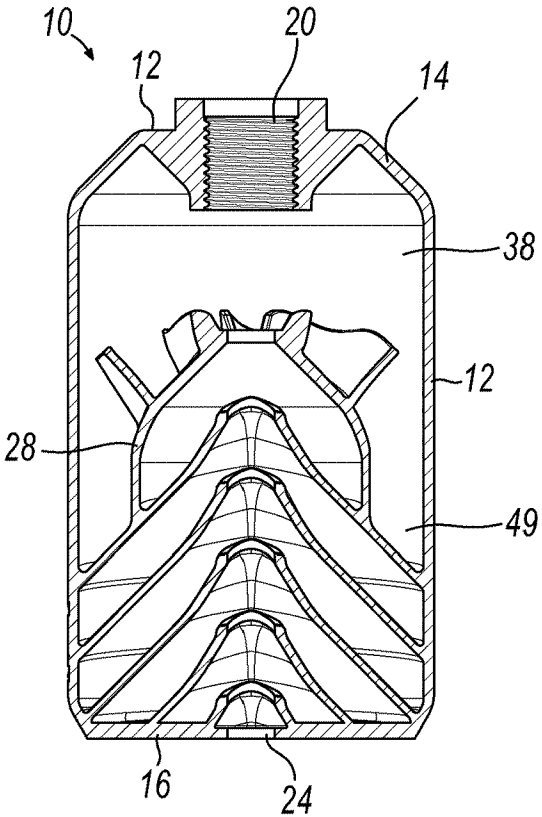
Figure 8:
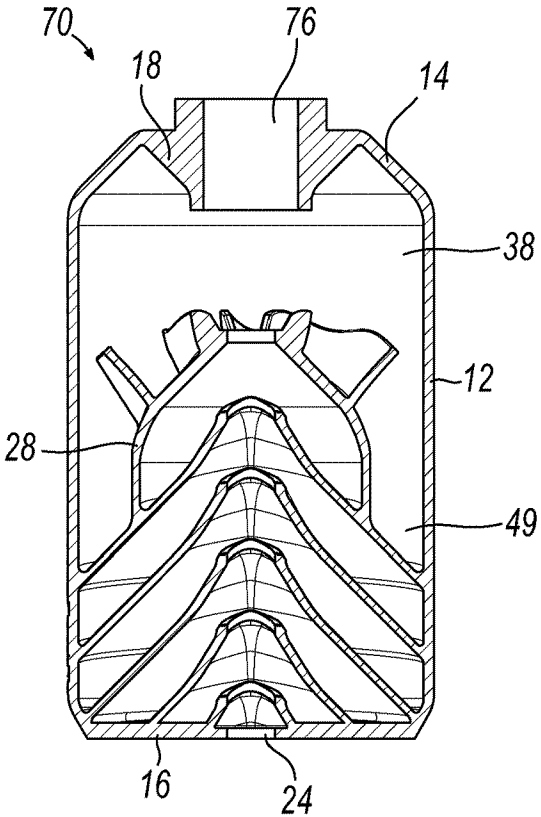
Figure 7:
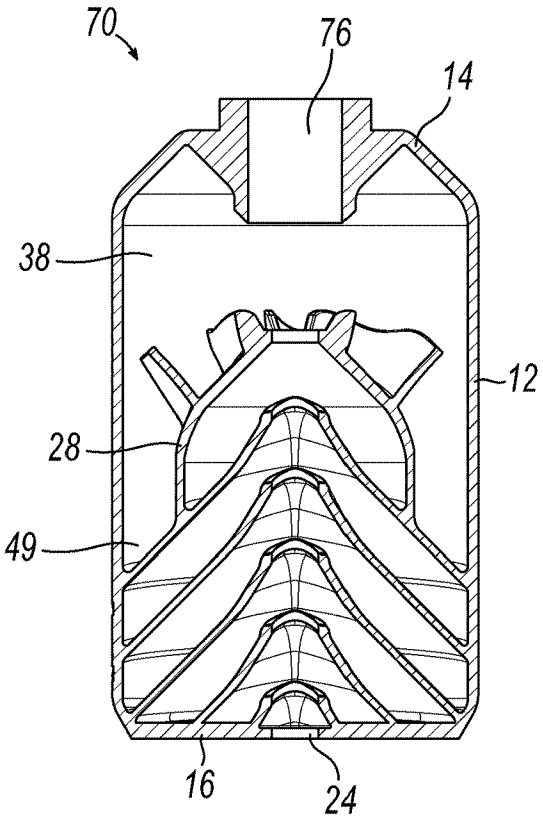

Referring now to FIG. 7, a rear end wall opening 76 may be formed to a final desired diameter, ready for threading for attachment to the muzzle of a firearm barrel or for insertion of a separate threaded bushing (not shown) for the same purpose. Referring to FIG. 8, additional internal support structure may be removed to define a final axial length of the rear end wall opening 76 and neck portion 18. This maximizes the volume of the blast chamber 38, while leaving adequate structural support and axial length in the neck portion 18 of the rear end wall 14. Referring finally to FIG. 9, the rear end wall opening 76 may be finished by cutting the previously described threaded surface 20. Alternatively, the rear end wall opening 76 may be fitted with a quick-disconnect mechanism, threaded bushing, or other means for attachment to a firearm barrel. Other processing steps may be required to treat the material or portions thereof from which the suppressor 10 is formed and/or application of one or more surface coatings in order to provide the desired strength and surface qualities for a functioning suppressor 10.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A method of manufacturing a firearm noise suppressor, comprising the steps of:

printing by additive manufacturing a firearm noise suppressor precursor part having a housing having a center axis, side walls, a forward end wall, a rearward end wall, and defining an internal volume, having internal baffles separating the internal volume into chambers, and having temporary internal support structure along at least a portion of the center axis;

boring out a central bore passageway along the center axis to remove the temporary internal support structure and to form openings of predetermined size in the baffles and forward wall and to form an interim opening in the rearward wall;

removing internal manufacturing debris from the chambers through at least one of the interim opening and the forward wall opening;

boring out a larger opening in the rearward wall to form an attachment opening; and providing attachment means in the attachment opening.

2. The method of claim 1, wherein the temporary internal support structure extends to a blast baffle defining a blast chamber, the temporary internal support structure includes at least first and second temporary passageways operably venting the blast chamber to outside the housing; and the step of removing internal manufacturing debris includes introducing a stream of air through the first temporary passageway to create a flow of air through the blast baffle to fluidize the debris and exhaust it through the second temporary passageway.

3. The method of claim 1, wherein at least one baffle is supported by the side walls.

4. The method of claim 1, wherein at least one baffle is supported by the forward end wall.

5. The method of claim 1, wherein the attachment means includes threads.

* * * * *